US009981311B2

(12) United States Patent
Fukumoto et al.

(10) Patent No.: US 9,981,311 B2
(45) Date of Patent: May 29, 2018

(54) BOTTOM-POURING-TYPE LADLE, AND MELT-POURING METHOD USING IT

(71) Applicant: HITACHI METALS, LTD., Tokyo (JP)

(72) Inventors: Kentaro Fukumoto, Miyako-gun (JP); Syuuhei Ishibashi, Miyako-gun (JP)

(73) Assignee: HITACHI METALS, LTD., Tokyo (JP)

( * ) Notice: Subject to any disclaimer, the term of this patent is extended or adjusted under 35 U.S.C. 154(b) by 70 days.

(21) Appl. No.: 14/774,900

(22) PCT Filed: Mar. 10, 2014

(86) PCT No.: PCT/JP2014/056131

§ 371 (c)(1),
(2) Date: Sep. 11, 2015

(87) PCT Pub. No.: WO2014/142059

PCT Pub. Date: Sep. 18, 2014

(65) Prior Publication Data

US 2016/0023271 A1 Jan. 28, 2016

(30) Foreign Application Priority Data

Mar. 12, 2013 (JP) ..... 2013-048909
Dec. 27, 2013 (JP) ..... 2013-270664

(51) Int. Cl.

| | |
|---|---|
| ***B22D 41/08*** | (2006.01) |
| ***B22D 41/16*** | (2006.01) |
| ***B22D 41/50*** | (2006.01) |
| ***B22D 41/18*** | (2006.01) |

(52) U.S. Cl.
CPC ..... *B22D 41/16* (2013.01); *B22D 41/08* (2013.01); *B22D 41/18* (2013.01); *B22D 41/50* (2013.01)

(58) Field of Classification Search
CPC ..... B22D 41/16; B22D 41/20
USPC ..... 266/271
See application file for complete search history.

(56) References Cited

U.S. PATENT DOCUMENTS 3,627,180 A * 12/1971 Montgomery ..... B22D 41/20 222/559
2016/0023271 A1* 1/2016 Fukumoto ..... B22D 41/18 222/590

FOREIGN PATENT DOCUMENTS

| | | | |
|---|---|---|---|
| JP | 51-058119 | U | 5/1976 |
| JP | 53-160421 | U | 12/1978 |
| JP | 1-28944 | Y2 | 9/1989 |
| JP | 3-124363 | A | 5/1991 |

(Continued)

OTHER PUBLICATIONS

International Search Report for PCT/JP2014/056131 dated May 27, 2014.

*Primary Examiner* — Scott Kastler
(74) *Attorney, Agent, or Firm* — Sughrue Mion, PLLC

(57) ABSTRACT

A method for pouring a melt using a bottom-pouring-type ladle comprising a melt-pouring nozzle and a stopper rod, comprises an opening step, in which the stopper rod is separate from the nozzle; a first closing step, in which the stopper rod moves downward, such that a lower end portion of the stopper rod comes into contact with a tapered surface of the nozzle when the horizontal distance between their center axes becomes 2 mm or more; and a second closing step, in which a lower end portion of the stopper rod further moves downward along the tapered surface of the nozzle to close the nozzle.

8 Claims, 10 Drawing Sheets

(56) References Cited

FOREIGN PATENT DOCUMENTS

| | | | |
|---|---|---|---|
| JP | 7-100632 | A | 4/1995 |
| JP | 9-57426 | A | 3/1997 |
| JP | 2001-129644 | A | 5/2001 |

* cited by examiner

Fig. 10(b) COVENTIONAL ART

BOTTOM-POURING-TYPE LADLE, AND MELT-POURING METHOD USING IT

CROSS REFERENCE TO RELATED APPLICATIONS

This application is a National Stage of International Application No. PCT/JP2014/056131 filed Mar. 10, 2014 (claiming priority based on Japanese Patent Application Nos. 2013-048909 filed Mar. 12, 2013 and 2013-270664 filed Dec. 27, 2013), the contents of which are incorporated herein by reference in their entirety.

FIELD OF THE INVENTION

The present invention relates to a bottom-pouring-type ladle comprising a stopper rod for opening and closing an upper opening of a nozzle, and a melt-pouring method using it.

BACKGROUND OF THE INVENTION

A melt-pouring system controlling the amount of a metal melt cast into a mold from a nozzle of a bottom-pouring-type ladle by opening and closing an upper opening of the nozzle in the ladle bottom by a stopper rod is widely used in casting, because it is advantageous in permitting less inclusions floating on the melt in the ladle to enter the mold.

FIGS. 10(*a*) and 10(*b*) schematically show a conventional bottom-pouring-type ladle. This bottom-pouring-type ladle 21 comprises a ladle body 2, a nozzle 3 provided in a bottom portion of the ladle body 2, a stopper rod 4 for closing the nozzle 3, an arm 5 supporting the stopper rod 4, and an elevating mechanism 6 for vertically moving the arm 5. The nozzle 3, which is usually formed by heat-resistant ceramics, has a reverse-conically tapered surface, or a spherically tapered surface having a convexly arcuate cross section. The stopper rod 4 is usually constituted by a sleeve 41 made of refractory materials such as graphite, and a metal-made core shaft 42 supporting the sleeve 41. The sleeve 41 usually has a reverse-conically tapered or semispherical lower end portion 41*a*. The arm 5 is constituted by a vertical arm portion 5*a* and a horizontal arm portion 5*b*, and the core shaft 42 is threadably attached to a tip end portion of the horizontal arm portion 5*b* with support members 7. In the depicted example, the nozzle 3 has an upper opening 10 having a spherically tapered surface 3*a* with an inward projecting fan-shaped cross section, and the stopper rod 4 has a semispherical lower end portion 41*a*.

As shown in FIG. 10(*a*), when the stopper rod 4 is separate from the nozzle 3, a centerline $O_2$ of the stopper rod 4 is substantially aligned with a centerline $O_1$ of the nozzle 3. With the stopper rod 4 moving downward by the elevating mechanism 6 in this state, as shown in FIG. 10(*b*), the semispherical lower end portion 41*a* of the stopper rod 4 comes into close contact with the spherically tapered surface 3*a* of the nozzle 3, thereby closing the upper opening 10. In this state, a melt (not shown) is poured into the ladle body 2.

After the melt is poured into the ladle body 2 in the closed state shown in FIG. 10(*b*), the stopper rod 4 is lifted for a predetermined period of time as shown in FIG. 10(*a*) to discharge a predetermined amount of a melt through the nozzle 3, and then the stopper rod 4 is moved downward again. Because the centerline $O_2$ of the stopper rod 4 is substantially aligned with the centerline $O_1$ of the nozzle 3, the nozzle 3 must be closed. However, it is actually likely that the leakage of a melt through the nozzle 3 takes place in the state shown in FIG. 10(*b*). It has been found that the leakage of a melt through the nozzle 3 tends to increase as melt-pouring cycles are repeated.

When more than an acceptable amount of a melt is poured into the mold by leakage, or when a melt leaking before the start of pouring flows into the mold, defects called melt ball and cold shut may occur. Though the stopper rod 4 may be strongly pushed to the nozzle 3 with a large load, it would likely break the heat-resistant sleeve 41 of the stopper rod 4 or the nozzle 3.

As a result of intensive research to solve such a problem as the leakage of a melt, it has been found that (a) while a melt is discharged, not only inclusions in the melt but also a semi-solid melt are attached to the spherically tapered surface 3*a* of the nozzle 3, that (b) the inclusions and the semi-solid melt attached to the spherically tapered surface 3*a* of the nozzle 3 hinder the semispherical lower end portion 41*a* of the stopper rod 4 from coming into close contact with the spherically tapered surface 3*a* of the nozzle 3, and that (c) when a load necessary for downward movement while crushing or sliding the inclusions and the semi-solid melt attached to the spherically tapered surface 3*a* of the nozzle 3 is applied to the stopper rod 4, one or both of the semispherical lower end portion 41*a* of the stopper rod 4 and the nozzle 3 are likely damaged.

To cope with such a problem, JP 3-124363 A discloses, as shown in FIG. 11, a melt-pouring apparatus for supplying a predetermined amount of a melt from a decanting-type ladle to a basin 16, and then pouring this melt into a sprue 54 of a mold 41 with a melt-dropping nozzle 51 of the basin 16. This melt-pouring apparatus comprises a sand mold nozzle 53 in an upper portion of the mold 41, which is separate from the basin 16 and comes into close contact with the melt-dropping nozzle 51 of the basin 16; the sand mold nozzle 53 having the sprue 54; and the sprue 54 having a stopper-abutting seat 55 closely engageable with a stopper 25 entering the melt-dropping nozzle 51 of the basin 16. With this melt-pouring apparatus, without applying a large load to the stopper 25, the stopper 25 can come into highly close contact with the sand mold nozzle 53. However, the melt-pouring apparatus of JP 3-124363 A is an apparatus introducing a melt into the basin 16 from the decanting-type ladle, and then controlling the amount of a melt poured from the basin 16 to the mold 41, but not an apparatus controlling the amount of a melt poured from a bottom-pouring-type ladle. Accordingly, the nozzle 53 coming into contact with the stopper 25 is part of the sand mold, free from the problem of inclusions and a semi-solid melt attached.

Japanese Utility Model Publication No. 1-28944 discloses, as shown in FIG. 12, an apparatus for opening an outlet of a melt container, which comprises a main frame 112; two arms 104, 105 pivotally supported by the main frame 112; a frame 101 pivotally mounted to tip ends of the arms 104, 105; a driving means 108 fixed to the frame 101; an on-off rod 102 moved back and forth by the driving means 108; a plug 103 fixed to a tip end of the on-off rod 102; an arm-swinging means 106 pivotally supported by the main frame 112; links 109, 110 moving back and forth by the arm-swinging means 106 and pivotally connected to the main frame 112 and the arm 105; and a melt container outlet 111, into which the plug 103 of the on-off rod 102 is inserted; the plug 103 moving along a circular locus by two arms 104, 105 and the on-off rod 102, so that it comes into contact with an upper inner surface of the outlet 111, and then with the entire outlet 111. This outlet-opening apparatus is suitable for an aluminum melt, using a conical plug 103 to a cylindrical outlet 111. However, because the cylindrical outlet 111 does not have a tapered opening, the conical plug 103 is always in contact with an upper edge of the outlet 111, resulting in large wear. In addition, the contact of the cylindrical outlet 111 with the conical plug 103 does not provide sufficient closing, failing to prevent leakage when closed.

OBJECT OF THE INVENTION

Accordingly, the first object of the present invention is to provide a bottom-pouring-type ladle capable of preventing the leakage of a cast steel melt from a nozzle without applying a large load to a stopper rod, when a predetermined amount of a cast steel melt is poured through a nozzle.

The second object of the present invention is to provide a method for pouring a melt using such a bottom-pouring-type ladle, while preventing leakage through the nozzle.

SUMMARY OF THE INVENTION

As a result of intensive research in view of the above objects, the inventors have found that in a bottom-pouring-type melt ladle, by bringing a stopper rod into contact with a nozzle with a center axis of the stopper rod separate from a center axis of the nozzle, and then sliding the stopper rod down on the nozzle surface to close the nozzle, the nozzle can be completely closed only with a small load applied to the stopper rod, and melt leakage through the nozzle can be prevented even after repeating melt-pouring cycles. The present invention has been completed based on such finding.

Thus, the bottom-pouring-type melt ladle of the present invention comprises a melt-pouring nozzle, and a vertically movable stopper rod for opening and closing an upper opening of the nozzle;

an upper opening of the nozzle having a reverse-conically tapered surface or a spherically tapered surface providing an inward projecting fan-shaped cross section;

a lower end portion of the stopper rod having a reverse-conically tapered surface or a spherical surface, provided that it has a spherical surface when the upper opening of the nozzle has a reverse-conically tapered surface;

the stopper rod being upward separate from the nozzle, with a center axis of the stopper rod horizontally separate from a center axis of the nozzle, in a state where the nozzle is open;

when the lower end portion of the stopper rod moving downward comes into contact with the tapered surface of the nozzle, the horizontal distance between the center axis of the stopper rod and the center axis of the nozzle being 2 mm or more at their contact point; and when the stopper rod further moves downward, the lower end portion of the stopper rod sliding downward on the tapered surface of the nozzle, thereby closing the upper opening of the nozzle.

In the above bottom-pouring-type ladle, it is preferable that (a) when the stopper rod is lifted from a state where the nozzle is closed, the stopper rod moves upward along the tapered surface of the nozzle, until the horizontal distance between the center axis of the stopper rod and the center axis of the nozzle becomes 2 mm or more at their contact point; and that (b) when the stopper rod is further lifted, the stopper rod is separated from the tapered surface of the nozzle to open the upper opening of the nozzle.

The method of the present invention for pouring a melt uses a bottom-pouring-type ladle comprising a melt-pouring nozzle, and a vertically movable stopper rod for opening and closing an upper opening of the nozzle;

the upper opening of the nozzle having a reverse-conically tapered surface or a spherically tapered surface providing an inward projecting fan-shaped cross section; and the lower end portion of the stopper rod having a reverse-conically tapered surface or a spherical surface, provided that it has a spherical surface when the upper opening of the nozzle has a reverse-conically tapered surface; the method comprising an opening step, in which the stopper rod is upward separate from the nozzle, with a center axis of the stopper rod horizontally separate from a center axis of the nozzle;

a first closing step, in which the stopper rod moves downward, such that the lower end portion of the stopper rod comes into contact with the tapered surface of the nozzle, at a position where the horizontal distance between the center axis of the stopper rod and the center axis of the nozzle is 2 mm or more; and a second closing step, in which the lower end portion of the stopper rod further moves downward along the tapered surface of the nozzle, thereby closing the upper opening of the nozzle.

In the above method, the nozzle is preferably opened by a first opening step, in which the stopper rod is lifted along the tapered surface of the nozzle, until the horizontal distance between the center axis of the stopper rod and the center axis of the nozzle becomes 2 mm or more at their contact point; and a second opening step, in which the stopper rod is further lifted to completely open the upper opening of the nozzle.

When the lower end portion of the stopper rod moving downward comes into contact with the tapered surface of the nozzle, there are four combinations of their contact surfaces, depending on whether the lower end portion of the stopper rod has a spherical surface or a reverse conical surface, and whether the nozzle has a reverse-conically tapered surface or a spherically tapered surface. Among them, there are three combinations, in which at least one has a curved surface (spherical surface); (a) when a spherical lower end portion of the stopper rod moving downward comes into contact with a spherically tapered surface of the nozzle, (b) when a spherical lower end portion of the stopper rod moving downward comes into contact with a reverse-conically tapered surface of the nozzle, and (c) when a reverse-conical lower end portion of the stopper rod moving downward comes into contact with a spherically tapered surface of the nozzle. At their contact point, an angle between a normal line of the spherically tapered surface of the nozzle and the center axis of the nozzle [in the cases (a) and (c)], and an angle between a normal line of the spherical lower end portion of the stopper rod and the center axis of the nozzle [in the case (b)] are both preferably 25° or more.

When the nozzle is closed by the stopper rod, an angle between a normal line of the spherically tapered surface of the nozzle or the spherical lower end portion of the stopper rod and the center axis of the nozzle is preferably 60° or less at their contact point.

BRIEF DESCRIPTION OF THE DRAWINGS

FIG. 1(*b*) is a partially cross-sectional schematic view showing a bottom-pouring-type ladle according to the first embodiment of the present invention, in a state where a stopper rod is first brought into contact with a nozzle.

FIG. 1(*c*) is a partially cross-sectional schematic view showing a bottom-pouring-type ladle according to the first embodiment of the present invention, in a state where a nozzle is closed by a stopper rod.

FIG. 8(*b*) is a partially enlarged schematic view showing the relation between a lower end portion of the stopper rod and a tapered surface of the nozzle in the second closing step, in the second embodiment.

FIG. 9(*b*) is a partially enlarged schematic view showing the relation between a lower end portion of the stopper rod and a tapered surface of the nozzle in the second closing step, in the third embodiment.

FIG. 10(*b*) is a partially cross-sectional schematic view showing a conventional bottom-pouring-type ladle, in which a nozzle is closed by a stopper rod.

DESCRIPTION OF THE PREFERRED EMBODIMENTS

Though the embodiments of the present invention are explained in detail below, the present invention is not restricted thereto, but modifications may be made properly in a range not deviating from the scope of the present invention. Explanations of each embodiment are applicable to other embodiments unless otherwise mentioned.

[1] First Embodiment (1) Structure of Bottom-Pouring-Type Ladle

Figure 1A:
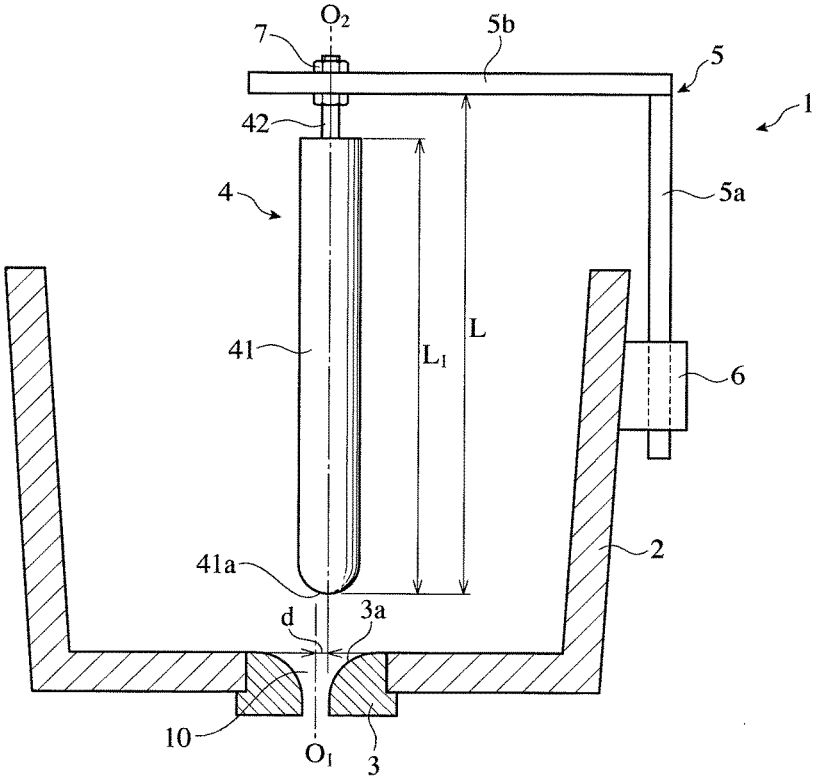
FIG. 1(*a*) is a partially cross-sectional schematic view showing a bottom-pouring-type ladle according to the first embodiment of the present invention, in a state where a stopper rod is at an elevated position.
Figure 1B:
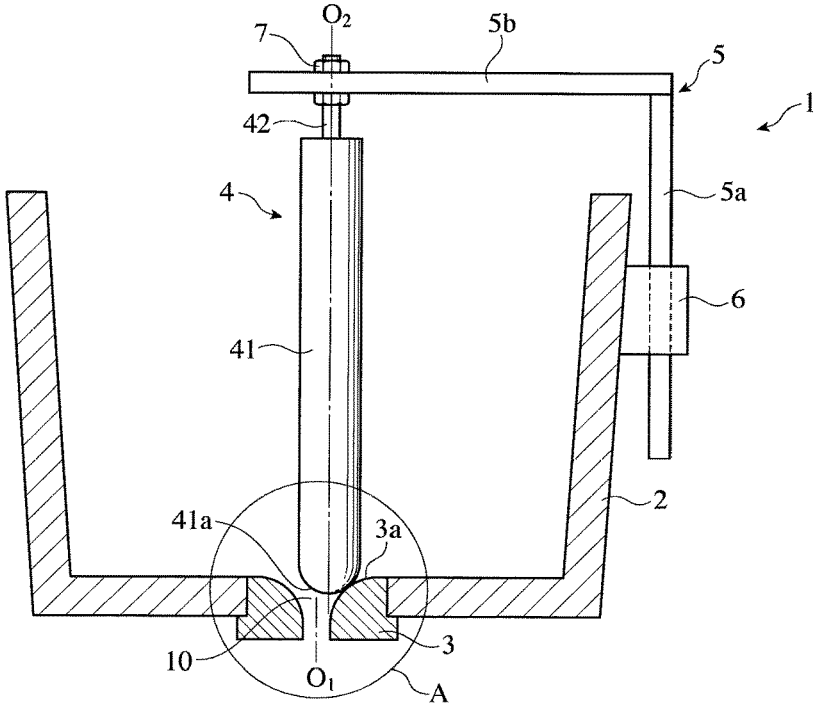
Figure 1C:
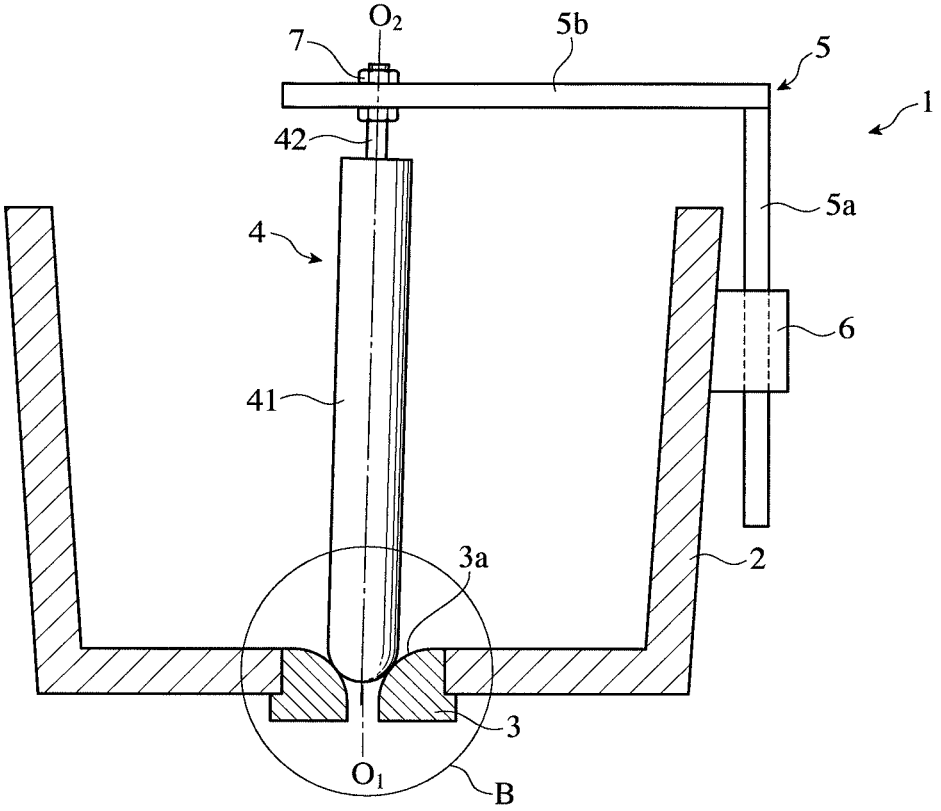

As shown in FIG. 1(*a*), the bottom-pouring-type ladle 1 according to the first embodiment of the present invention comprises an upper-opened ladle body 2, a nozzle 3 disposed in a bottom portion of the ladle body 2, a stopper rod 4 for closing the nozzle 3, an arm 5 supporting the stopper rod 4, and an elevating mechanism 6 vertically moving the arm 5. The nozzle 3 is preferably formed by heat-resistant ceramics such as silicon nitride. The stopper rod 4 is preferably constituted by a substantially cylindrical sleeve 41 made of refractory materials such as graphite, and a metal-made core shaft 42 supporting the sleeve 41.

In this embodiment, the upper opening 10 of the nozzle 3 has a spherically tapered surface 3*a* providing an inward projecting fan-shaped cross section, which is axially symmetric with respect to a center axis $O_1$. The lower end portion 41*a* of the sleeve 41 has a spherical surface, which is axially symmetric with respect to a center axis $O_2$. The "spherical surface" is not restricted to a spherical surface having a completely constant radius, but may be a spherical surface having a radius slightly changing depending on the angle from the center axis $O_2$. The lower end portion 41*a* of the sleeve 41 is preferably semispherical. The spherical lower end portion 41*a* of the stopper rod 4 abutting the spherically tapered surface 3*a* of the nozzle 3 with an inward projecting fan-shaped cross section can further move downward by sliding on the spherically tapered surface 3*a* with a small force. In addition, even when the nozzle 3 has a reverse-conically tapered surface, sufficiently close contact is secured regardless of the inclination of the stopper rod 4, as long as the curved-surface lower end portion 41*a* of the stopper rod 4 has a spherical surface.

The arm 5 is constituted by a vertical arm portion 5*a* vertically movable by the elevating mechanism 6 mounted to the ladle 2, and a horizontal arm portion 5*b* rectangularly fixed to the vertical arm portion 5*a*. The structure of the elevating mechanism 6 is not restricted, as long as the arm 5 is vertically movable. The elevating mechanism 6 may be, for example, a rack and pinion type or a hydraulic type.

Figure 2:
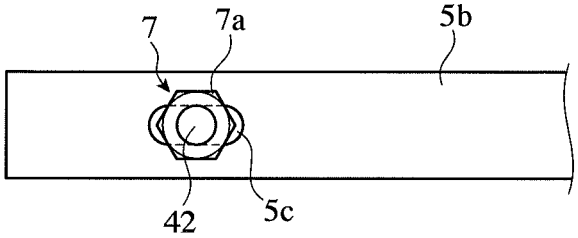
FIG. 2 is a plan view showing a support for threadably fixing a core shaft of a stopper rod to a horizontal arm portion of an arm.
Figure 4:
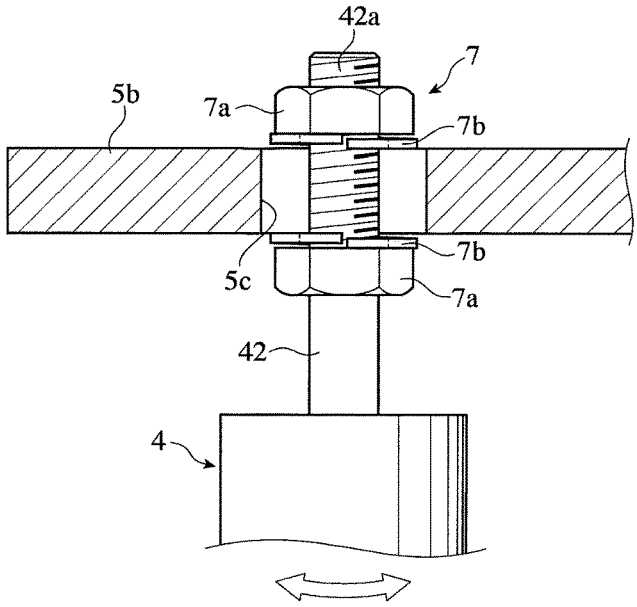
FIG. 4 is a cross-sectional view showing an example of swingable supports.

As shown in FIGS. 2 and 4, a tip end portion of the horizontal arm portion 5*b* is provided with an elongated hole 5*c*, and a male screw portion 42*a* of the core shaft 42 of the stopper rod 4 having an outer diameter substantially equal to the width of the elongated hole 5*c* penetrates the elongated hole 5*c*, and then threadably fixed by a pair of nuts 7*a*, 7*a*. With such a structure, the core shaft 42 of the stopper rod 4 can be set at an arbitrary horizontal position.

Figure 3:
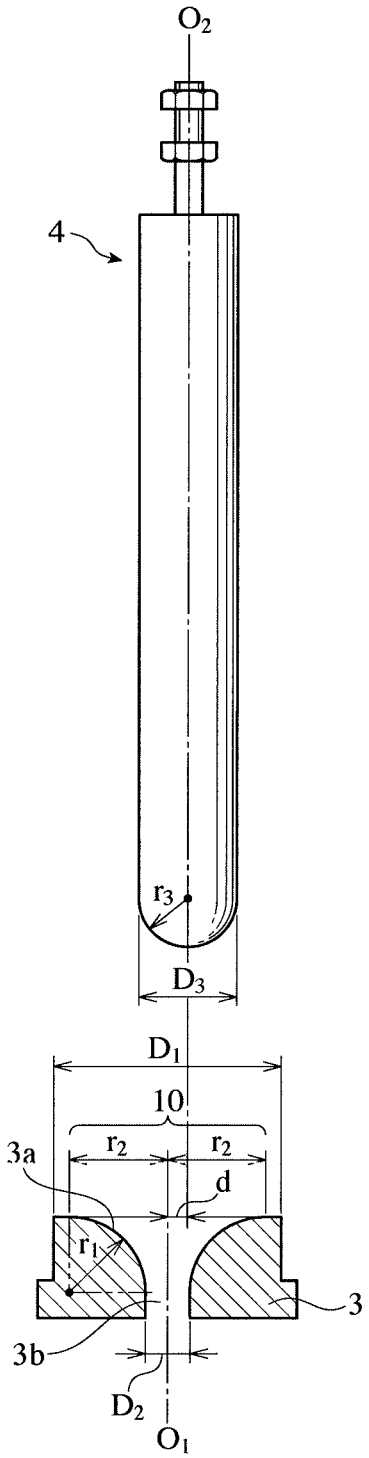
FIG. 3 is a schematic view showing the details of a nozzle and a stopper rod.

As shown in FIG. 3, the nozzle 3 has a doughnut shape having an upper opening 10 having an inward projecting fan-shaped cross section with a spherically tapered surface 3*a*. The nozzle 3 has an upper surface having a diameter $D_1$, a spherically tapered surface 3*a* having a radius $r_1$ inside the upper surface, and a penetrating center hole 3*b* surrounded by the spherically tapered surface 3*a*. Because the penetrating hole 3*b* has a diameter $D_2$, the radius $r_2$ of the upper opening 10 is $r_1+D_2/2$. Thus, the upper surface of the nozzle 3 has a peripheral flat portion having a width of $D_1/2-r_2$. The semispherical lower end portion 41*a* of the sleeve 41 of the stopper rod 4 has a radius $r_3$ and a diameter $D_3$. When the semispherical lower end portion 41*a* is completely semispherical, $D_3=2r_3$.

In the example shown in FIG. 3, because the stopper rod 4 has a vertical center axis $O_2$, the center axis $O_2$ of the stopper rod 4 and the center axis $O_1$ of the nozzle 3 have the same horizontal distance d at any height when the nozzle 3 is open. However, when the center axis $O_2$ of the stopper rod 4 is inclined, the horizontal distance d is measured in a plane passing the upper end of the upper opening 10 as depicted.

As described below, in the present invention, the center axis $O_2$ of the stopper rod 4 is horizontally separate from the center axis $O_1$ of the nozzle 3 when the stopper rod 4 is lifted, but the stopper rod 4 moves downward along the spherically tapered surface 3*a* of the nozzle 3, needing a mechanism capable of absorbing deviation by the movement. A mechanism for absorbing the horizontal movement of the center axis of the stopper rod 4 includes (a) swinging of the support 7, (b) swinging of the vertical arm portion 5*a* by the elevating mechanism 6, etc. From the aspect of an easy structure, it is preferable to make the support 7 swingable.

An example of swingable supports 7 comprises, as shown in FIG. 4, a male screw portion 42*a* provided in an upper portion of the core shaft 42 of the stopper rod 4, a pair of nuts 7*a*, 7*a* threadably engaging the male screw portion 42*a* penetrating the elongated hole 5*c* of the horizontal arm portion 5*b* from both sides, and washers 7*b* each disposed under each nut 7*a* (on the side of the horizontal arm portion 5*b*). Each washer 7*b* should be elastically deformable like a spring washer with a gap defined by deviated ends. When the nuts 7*a*, 7*a* threadably engage the male screw portion 42*a* of the core shaft 42, (a) with the core shaft 42 longitudinally unmovable in the elongated hole 5*c*, and (*b*) with the washers 7*b*, 7*b* elastically deformable, the core shaft 42 of the stopper rod 4 is slightly swingable with the support 7 as a center, in the longitudinal direction of the elongated hole 5*c*. The fastening force of the nuts 7*a*, 7*a* (elastic force of the washers 7*b*, 7*b*) should avoid the breakage of the semispherical lower end portion 41*a* and the spherically tapered surface 3*a*, when the semispherical lower end portion 41*a* of the stopper rod 4 slides along the spherically tapered surface 3*a* of the nozzle 3. As a result, as the stopper rod 4 moves downward, the lower end portion 41*a* of the sleeve 41 of the stopper rod 4 can move along the spherically tapered surface 3*a* by several millimeters horizontally, without breaking the semispherical lower end portion 41*a* and the spherically tapered surface 3*a*.

Figure 5:
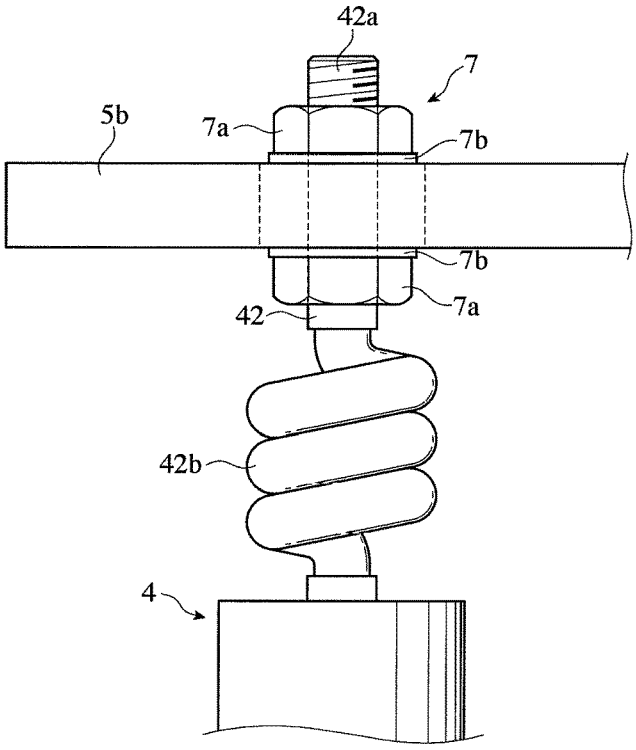
FIG. 5 is a side view showing another example of swingable supports.

Another example of swingable supports 7 comprises, as shown in FIG. 5, a pair of nuts 7*a*, 7*a* threadably engaging the male screw portion 42*a* of the core shaft 42 of the stopper rod 4 strongly via a pair of washers 7*b*, 7*b*, and a spring portion 42*b* partially constituting the core shaft 42. The spring portion 42*b* is bendable by a horizontal force, but should not be deformable by a vertical force. Such a spring portion 42*b* is preferably a tight coil spring. In this example, because the washers 7*b*, 7*b* are not elastically deformable because of strong threadable engagement of the nuts 7*a*, 7*a* with the male screw portion 42*a*, the core shaft 42 swings by the spring portion 42*b*. As described above, the spring portion 42*b* should have such elasticity as to avoid the breakage of the semispherical lower end portion 41*a* and the spherically tapered surface 3*a*, when the semispherical lower end portion 41*a* of the stopper rod 4 slides along the spherically tapered surface 3*a* of the nozzle 3. As a result, as the stopper rod 4 moves downward, swinging by the spring portion 42*b* also makes the lower end portion 41*a* of the sleeve 41 of the stopper rod 4 movable along the spherically tapered surface 3*a* by several millimeters horizontally, without breaking the semispherical lower end portion 41*a* and the spherically tapered surface 3*a*.

(2) Melt-pouring method

Referring to FIGS. 1(*a*)-1(*c*), a melt-pouring method using the bottom-pouring-type ladle 1 of the first embodiment will be explained. The melt-pouring method of the present invention is suitable for a cast steel melt, which contains inclusions and a semi-solid melt attachable to the ladle, though not restrictive. A cast iron melt and an aluminum melt containing inclusions and a semi-solid melt attachable to the ladle are also usable.

(a) Opening Step

When the stopper rod 4 is upward separate from the nozzle 3 as shown in FIG. 1(*a*), the center axis $O_2$ of the stopper rod 4 is horizontally separate from the center axis $O_1$ of the nozzle 3. In the opening step, a horizontal distance d between the center axis $O_2$ of the stopper rod 4 and the center axis $O_1$ of the nozzle 3 is preferably 2 mm or more. The center axis $O_2$ of the stopper rod 4 may be vertical or inclined. The inclination of the stopper rod 4 is preferably on the side of the vertical arm portion 5*a* (right side in the figure).

(b) First Closing Step

When the stopper rod 4 moves downward as shown in FIG. 1(*b*), the semispherical lower end portion 41*a* of the sleeve 41 of the stopper rod 4 abuts the spherically tapered surface 3*a* of the nozzle 3. At this stage, the horizontal distance d between the center axis $O_2$ of the stopper rod 4 and the center axis $O_1$ of the nozzle 3 does not change. The distance d of 2 mm or more provides a large effect of gradually sliding and crushing inclusions and a semi-solid melt in a cast steel melt, so that the nozzle 3 can be efficiently closed and opened with a small load applied to the stopper rod 4. The distance d is more preferably 5 mm or more. The upper limit of the distance d is preferably 30 mm or less, more preferably 10 mm or less, though variable depending on the size of the nozzle 3 and the shape of the spherically tapered surface 3*a*.

Figure 6:
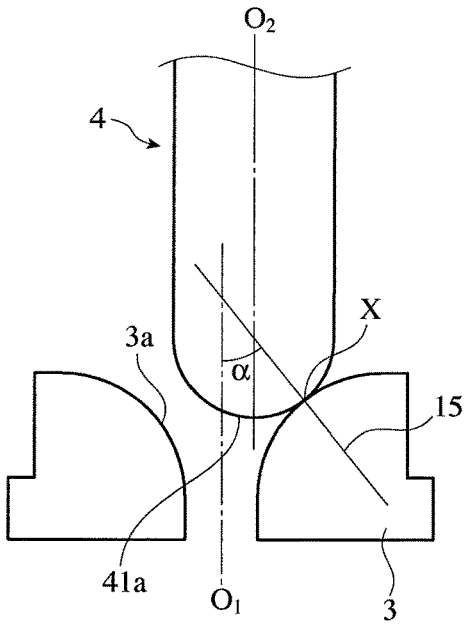
FIG. 6 is an enlarged view showing a portion A in FIG. 1(*b*).

As shown in FIG. 6, the semispherical lower end portion 41*a* of the sleeve 41 of the stopper rod 4 moving downward first comes into contact with the spherically tapered surface 3*a* of the nozzle 3, at a contact point X. At the contact point X, a larger angle $\alpha$ (acute angle side) between a normal line 15 of the spherically tapered surface 3*a* of the nozzle 3 or the semispherical lower end portion 41*a* of the stopper rod 4 and the center axis $O_1$ of the nozzle 3 makes the stopper rod 4 more easily slidable on the spherically tapered surface 3*a*, thereby reducing a necessary load applied to the stopper rod 4 to prevent leakage from the nozzle 3. Accordingly, the angle $\alpha$ is preferably 25° or more, more preferably 37-58°.

(c) Second Closing Step

As the stopper rod 4 further moves downward, the semispherical lower end portion 41*a* moves downward along the spherically tapered surface 3*a* of the nozzle 3, until their center axes $O_1$ and $O_2$ substantially overlap (their contact point lowers to the lowest point Y), thereby closing the upper opening 10 of the nozzle 3. When the stopper rod 4 moves downward to the lowest point Y, the center axis $O_1$ of the nozzle 3 may not completely overlap the center axis $O_2$ of the stopper rod 4. Even in such a case, the lower end portion 41*a* of the stopper rod 4 can come into close contact with the spherically tapered surface 3*a* of the nozzle 3, as long as the lower end portion 41*a* has a spherical surface.

As described above, in a state where both center axes $O_1$ and $O_2$ are separate from each other in the first closing step, the stopper rod 4 first comes into contact with the nozzle 3 at a point X, and then moves downward along the spherically tapered surface 3*a* of the nozzle 3, making the center axis $O_2$ of the stopper rod 4 closer to the center axis $O_1$ of the nozzle 3. As a result, a range in which the stopper rod 4 is in contact with the nozzle 3, or in which the stopper rod 4 is sufficiently close to the nozzle 3 to prevent the flowing of a melt, gradually expands, and the nozzle 3 is finally closed at the lowest point Y. At this time, the stopper rod 4 is inclined with the support 7 as a fulcrum, and the lower end portion 41*a* of the sleeve 41 of the stopper rod 4 moves along the spherically tapered surface 3*a* by several millimeters horizontally, without breaking the semispherical lower end portion 41*a* and the spherically tapered surface 3*a*.

As the semispherical lower end portion 41*a* of the stopper rod 4 slides along the spherically tapered surface 3*a* of the nozzle 3, a contact region of the stopper rod 4 with the nozzle 3 gradually increases, and inclusions and a semi-solid melt in the melt acting as resistance to the close contact of the stopper rod 4 with the nozzle 3 are gradually crushed or taken away, making it possible to close the nozzle 3 with a small load applied to the stopper rod 4.

Figure 7:
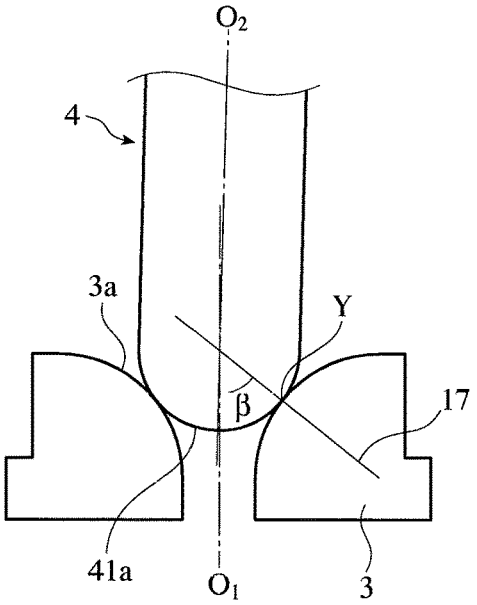
FIG. 7 is an enlarged view showing a portion B in FIG. 1(*c*).

As shown in FIG. 7, a smaller angle β (acute angle side) between a normal line 17 of the spherically tapered surface 3*a* of the nozzle 3 or the semispherical lower end portion 41*a* of the stopper rod 4 and the center axis $O_1$ of the nozzle 3 at the lowest point Y enables the stopper rod 4 to be lifted from the lowest point Y, at which the nozzle 3 is closed, with a smaller load. Accordingly, the angle β is preferably 60° or less, more preferably 42-54°.

(d) First Opening Step

As the stopper rod 4 is lifted from the closed state to open the nozzle 3, oppositely to the above, the semispherical lower end portion 41*a* of the stopper rod 4 slides on the spherically tapered surface 3*a* of the nozzle 3 to the point X in a direction separating from the center axis $O_1$ of the nozzle 3. As a result, a non-contact region of the stopper rod 4 with the nozzle 3 gradually increases.

(e) Second Opening Step

When the stopper rod 4 reaching the point X is further lifted, the upper opening 10 of the nozzle 3 is completely opened, so that a melt is poured from the bottom-pouring-type ladle 1 to a mold (not shown). As described above, the stopper rod 4 can be lifted with a small load, by conducting the first and second opening steps just oppositely to the first and second closing steps.

[2] Second Embodiment

Figure 8A:
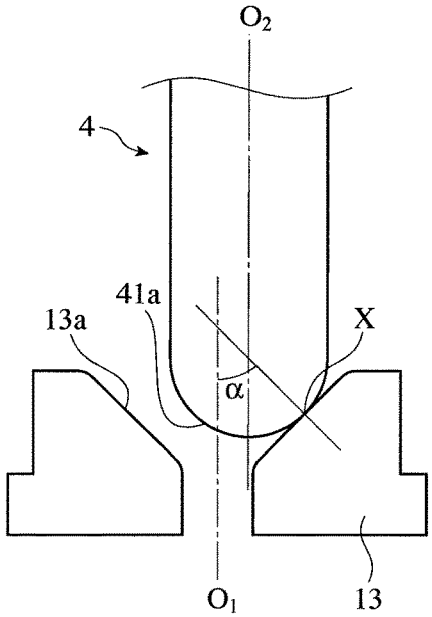
FIG. 8(*a*) is a partially enlarged schematic view showing the relation between a lower end portion of the stopper rod and a tapered surface of the nozzle in the first closing step, in the second embodiment.
Figure 8B:
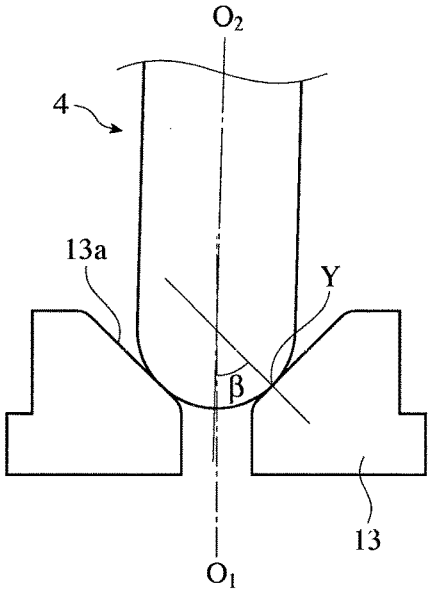

In this embodiment, as shown in FIGS. 8(*a*) and 8(*b*), the lower end portion 41*a* of the stopper rod 4 has a curved (semispherical) surface, and the tapered surface 13*a* of the nozzle 13 has a reverse-conically tapered surface. Except for this point, the second embodiment may be the same as the first embodiment.

In the second embodiment, too, a horizontal distance d between the center axis $O_2$ of the stopper rod 4 and the center axis $O_1$ of the nozzle 13 is 2 mm or more in the first closing step, and the semispherical lower end portion 41*a* moves downward along the reverse-conically tapered surface 13*a* of the nozzle 13 (their contact point lowers to the lowest point Y), until their center axes $O_1$ and $O_2$ substantially overlap, thereby closing the upper opening of the nozzle 13, in the second closing step. In the first closing step, an angle α between a normal line of the semispherical lower end portion 41*a* of the stopper rod 4 and the center axis $O_1$ of the nozzle 13 at the contact point X is preferably 25° or more. In the second closing step, a angle β between a normal line of the semispherical lower end portion 41*a* of the stopper rod 4 and the center axis $O_1$ of the nozzle 13 at the lowest point Y is preferably 60° or less.

[3] Third Embodiment

Figure 9A:
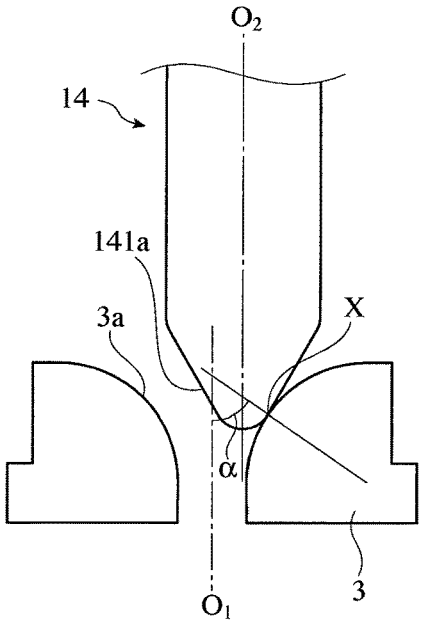
FIG. 9(*a*) is a partially enlarged schematic view showing the relation between a lower end portion of the stopper rod and a tapered surface of the nozzle in the first closing step, in the third embodiment.
Figure 9B:
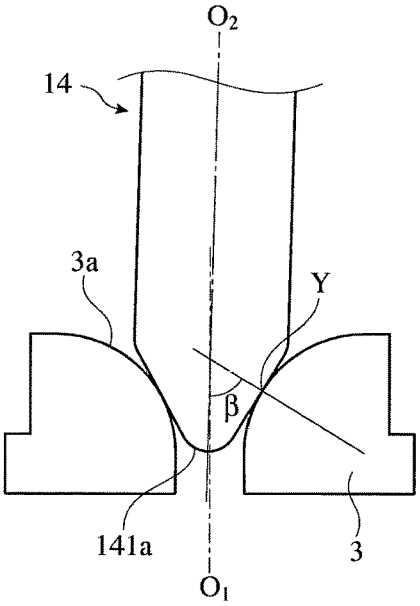
Figure 10A:
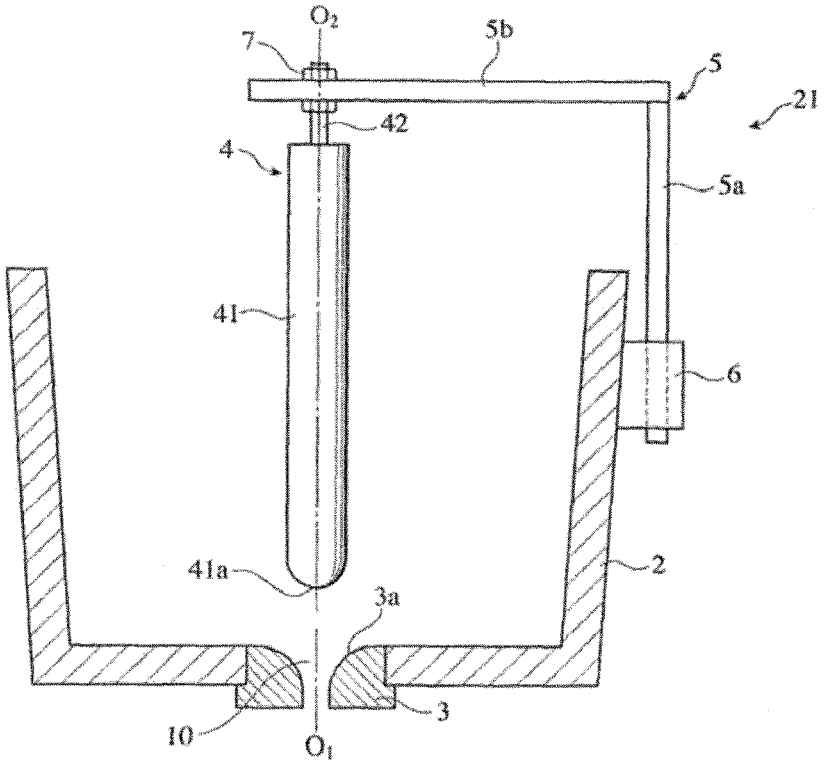
Fig. 10(a) CONVENTIONAL ART
FIG. 10(*a*) is a partially cross-sectional schematic view showing a conventional bottom-pouring-type ladle, in a state where a stopper rod is at an elevated position.
Figure 10A:
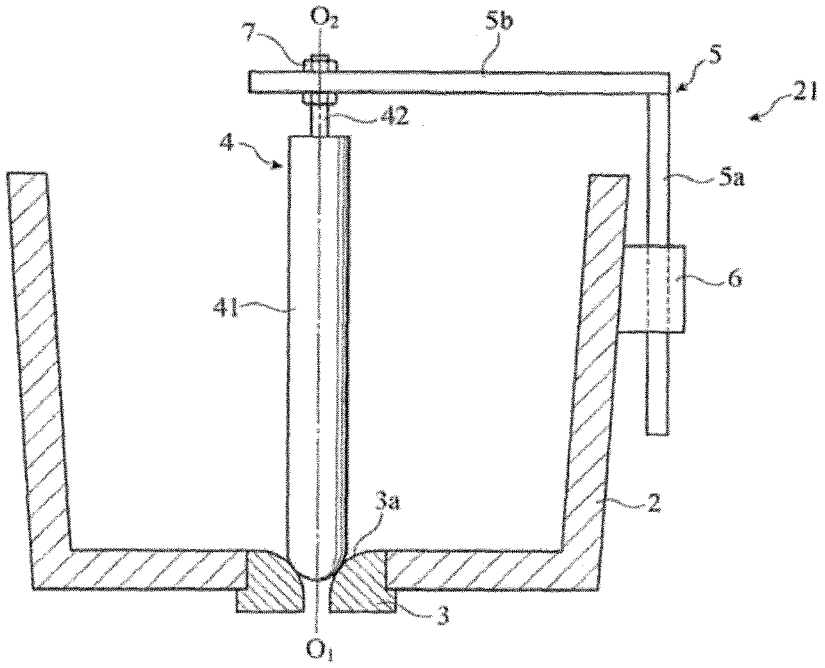
Fig. 10(a) CONVENTIONAL ART
Figure 11:
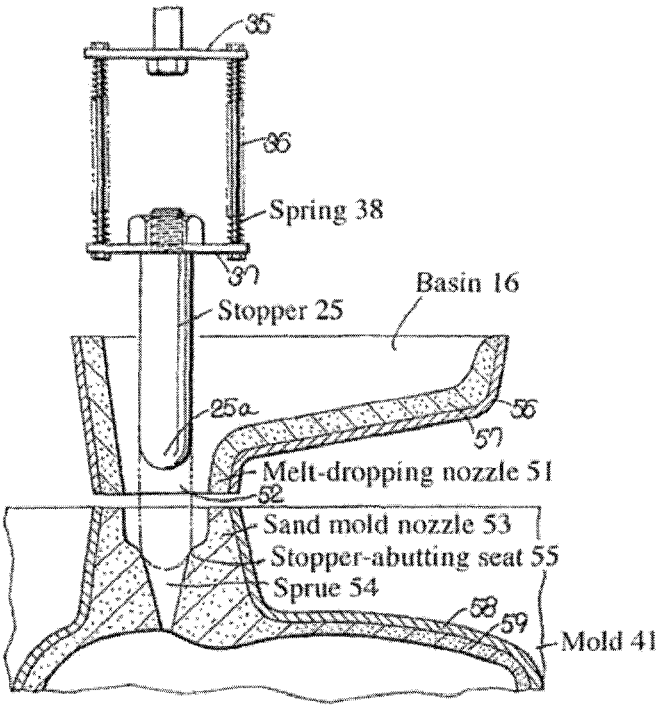
Fig. 11 PRIOR ART
FIG. 11 is a cross-sectional view showing a melt-pouring apparatus disclosed in JP 3-124363 A.
Figure 12:
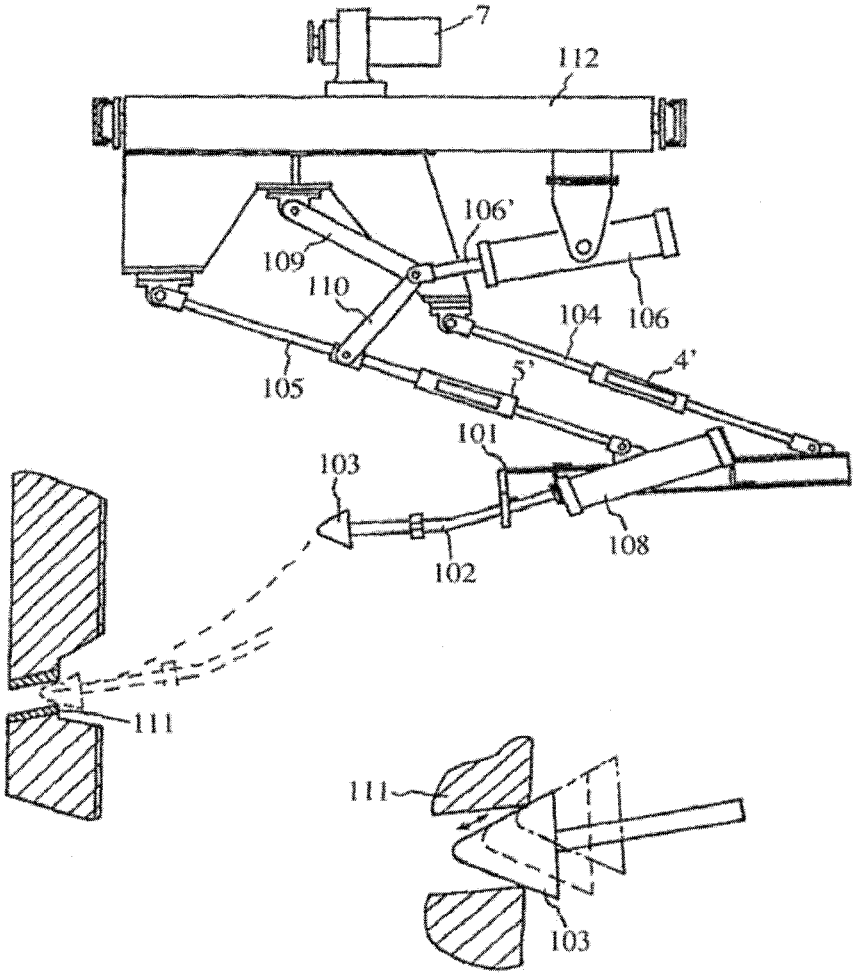
Fig. 12 PRIOR ART
FIG. 12 is a schematic view showing an outlet-opening apparatus of a melt container disclosed in Japanese Utility Model Publication No. 1-28944.

In this embodiment, as shown in FIGS. 9(*a*) and 9(*b*), the tapered surface 3*a* of the nozzle 3 is spherically tapered, and the lower end portion 141*a* of the stopper rod 14 has a reverse-conically tapered surface. Except for this point, the third embodiment may be the same as the first embodiment.

In the third embodiment, too, a horizontal distance d between the center axis $O_2$ of the stopper rod 14 and the center axis $O_1$ of the nozzle 3 in the first closing step is 2 mm or more, and the reverse-conical-tapered lower end portion 141*a* moves downward along the spherically tapered surface 3*a* of the nozzle 3 (their contact point lowers to the lowest point Y), until their center axes $O_1$ and $O_2$ substantially overlap, thereby closing the upper opening of the nozzle 3, in the second closing step. In the first closing step, an angle α between a normal line of the spherically tapered surface 3*a* of the nozzle 3 and the center axis $O_1$ of the nozzle 3 at the contact point X is preferably 25° or more. In the second closing step, an angle β between a normal line of the spherically tapered surface 3*a* of the nozzle 3 and the center axis $O_1$ of the nozzle 3 at the lowest point Y is preferably 60° or less.

The present invention will be explained in more detail by Examples below, without intention of restricting the present invention thereto. Though cast steel is taken for example in Examples, the present invention is of course not restricted thereto.

EXAMPLE 1

Using the bottom-pouring-type ladle 1 having the structure shown in FIGS. 1(*a*) to 3, a cast steel melt was poured. The ladle body 2 had a volume of 500 kg (expressed by the weight of cast steel), the nozzle 3 made of heat-resistant ceramics (silicon nitride) had an outer diameter $D_1$ of 160 mm, the penetrating hole 3*b* had an inner diameter $D_2$ of 40 mm, the spherically tapered surface 3*a* had a radius of curvature $r_1$ of 50 mm, and the upper opening 10 had a radius $r_2$ of 65 mm. The stopper rod 4 was constituted by a steel core shaft 42 having a radius of 10 mm, and a graphite sleeve 41. The sleeve 41 (semispherical lower end portion 41*a*) had a diameter $D_3$ of 100 mm and a length $L_1$ of 800 mm, and the semispherical lower end portion 41*a* had a radius $r_3$ of 50 mm. The length L of the stopper rod 4 (distance from a lower surface of the horizontal arm portion 5*b* to the lowest point of the semispherical lower end portion 41*a* of the sleeve 41) was 1000 mm.

At a position at which the nozzle 3 was closed by the stopper rod 4, as shown in FIG. 1(*c*), the male screw portion 42*a* of the core shaft 42 of the stopper rod 4 was inserted into the elongated hole 5*c* of the horizontal arm portion 5*b*, and threadably fixed by a pair of nuts 7*a*, 7*a*. The nuts 7*a*, 7*a* were fastened with such strength that the longitudinal position of the core shaft 42 could be changed by hammering the nut 7*a* and/or the core shaft 42. In this state, the center axis $O_1$ of the nozzle 3 was aligned with the center axis $O_2$ of the stopper rod 4.

The elevating mechanism 6 was operated from this state to elevate the vertical arm portion 5*a*, thereby lifting the stopper rod 4 by 50 mm to the state shown in FIG. 1(*a*). Thereafter, the stopper rod 4 was moved rightward by 10 mm by hammering the nuts 7*a*. In this state, the nuts 7*a*, 7*a* were fastened more strongly. The core shaft 42 was fastened with such strength that it did not move along the elongated hole 5*c* even when it was hit by a hammer, but that its inclination could be easily changed by horizontally pushing the lower end portion 41*a* of the sleeve 41.

By operating the elevating mechanism 6, the stopper rod 4 was moved downward to abut the nozzle 3 with a distance d of 10 mm between the center axis $O_1$ of the nozzle 3 and the center axis $O_2$ of the stopper rod 4 as shown in FIG. 1(*b*). At this time, an angle α between a normal line 15 of the nozzle 3 and the center axis $O_1$ of the nozzle 3 at the contact point X was 33° as shown in FIG. 6.

When the elevating mechanism 6 was operated to move the stopper rod 4 downward with a load of 130 N, the stopper rod 4 was inclined around the support 7, and the semispherical lower end portion 41*a* of the stopper rod 4 moved downward along the spherically tapered surface 3*a* of the nozzle 3 to substantially overlap the center axis $O_1$ of the nozzle 3 to the center axis $O_2$ of the stopper rod 4, thereby closing the nozzle 3. At this time, an angle β between a normal line 17 of the spherically tapered surface 3*a* of the nozzle 3 and the center axis $O_1$ of the nozzle 3 at the lowest point Y of the stopper rod 4 was 42° as shown in FIG. 7.

In this state, 500 kg of a cast steel melt at a temperature of 1600° C. was introduced into the ladle body 2. Considering buoyancy applied to the stopper rod 4 by the melt, the stopper rod 4 was pushed downward with a load of 130 N+170 N (buoyancy)=300 N, to keep the nozzle 3 closed.

To start pouring the cast steel melt, the stopper rod 4 was lifted with a pulling load of 120 N. With the stopper rod 4 lifted by 100 mm, the nozzle 3 was opened to pour about 12 kg of the melt into a mold (not shown), and the nozzle 3 was then closed through the same first and second closing steps as above. After repeating this cycle 30 times, no leakage occurred in the nozzle 3.

EXAMPLES 2-6

The melt-pouring cycle was repeated 30 times in the same manner as in Example 1, except for changing the distance d between the center axis $O_1$ of the nozzle 3 and the center axis $O_2$ of the stopper rod 4, and the angle α, as shown in Table 1. As a result, no leakage occurred in the nozzle during 30 cycles of melt-pouring.

EXAMPLES 7-9

The melt-pouring cycle was repeated 30 times in the same manner as in Example 1, except for changing the outer diameter of the sleeve 41 of the stopper rod 4 and the radius of the semispherical lower end portion 41*a*, with the distance d between the center axis $O_1$ of the nozzle 3 and the center axis $O_2$ of the stopper rod 4 fixed to 5 mm. No leakage occurred in the nozzle during 30 cycles of melt-pouring.

COMPARATIVE EXAMPLE 1

The above melt-pouring cycle was repeated 7 times, with no deviation of the center axis $O_2$ of the stopper rod 4 from the center axis $O_1$ of the nozzle 3, and with a closing load of 405 N. As a result, leakage occurred from the closed nozzle 3. Leakage stopped by increasing a load to the stopper rod 4 to 600 N, but the nozzle 3 was cracked at the eighth cycle after restarting pouring.

COMPARATIVE EXAMPLE 2

The melt-pouring was started in the same manner as in Comparative

Example 1, with no deviation of the center axis $O_2$ of the stopper rod 43 from the center axis $O_1$ of the nozzle 3, and with a load of 600 N applied to the stopper rod 4 from the beginning. As a result, the nozzle 3 was cracked at the 13th cycle after starting pouring.

It was found from Comparative Examples 1 and 2 that in a state where the center axis $O_1$ of the nozzle 3 is not separate from the center axis $O_2$ of the stopper rod 4, the stopper rod 4 should be pushed with a large load to prevent leakage from the closed nozzle 3, resulting in cracking in the nozzle 3. On the other hand, when the center axis $O_1$ of the nozzle 3 is separate from the center axis $O_2$ of the stopper rod 4 as in Examples 1-9, leakage from the nozzle 3 can be prevented, without a large closing load applied to the stopper rod 4. Small rod load and closing load were needed at the angle α of 25° or more, and a small pulling load was needed at the angle β of 60° or less.

Table 1 shows the diameter $D_3$ and radius $r_3$ of the sleeve 41 (semispherical lower end portion 41*a*), distance d, angles α and β, load to the stopper rod 4 (rod load), load to the stopper rod 4 (closing load) when the nozzle 3 was closed, load for lifting the stopper rod 4 (pulling load), leakage from the nozzle 3, and cracking of the nozzle 3, in Examples 1-9 and Comparative Examples 1 and 2.

TABLE 1

| Item | Example 1 | Example 2 | Example 3 | Example 4 | Example 5 | Example 6 |
|---|---|---|---|---|---|---|
| $D_3$ (mm) (1) | 100 | 100 | 100 | 100 | 100 | 100 |
| $r_3$ (mm) (2) | 50 | 50 | 50 | 50 | 50 | 50 |
| Distance d (mm) | 10 | 5 | 15 | 23 | 30 | 2 |
| Angle α (°) | 33 | 37 | 29 | 25 | 20 | 40 |
| Angle β (°) | 42 | 42 | 42 | 42 | 42 | 42 |
| Rod Load (N) | 130 | 120 | 145 | 165 | 250 | 115 |
| Closing Load (N) | 300 | 290 | 315 | 335 | 420 | 405 |
| Pulling Load (N) | 120 | 120 | 120 | 120 | 120 | 120 |
| Leakage from Nozzle | No | No | No | No | No | No |
| Cracking of Nozzle | No | No | No | No | No | No |

| Item | Example 7 | Example 8 | Example 9 | Com. Ex. 1 | Com. Ex. 2 |
|---|---|---|---|---|---|
| $D_3$ (mm) (1) | 45 | 50 | 60 | 100 | 100 |
| $r_3$ (mm) (2) | 22.5 | 25 | 30 | 50 | 50 |
| Distance d (mm) | 5 | 5 | 5 | 0 | 0 |
| Angle α (°) | 58 | 56 | 49 | — | — |
| Angle β (°) | 67 | 60 | 54 | 42 | 42 |

TABLE 1-continued

| | | | | | |
|---|---|---|---|---|---|
| Rod Load (N) | 105 | 112 | 114 | — | — |
| Closing Load (N) | 275 | 282 | 284 | 405→600 | 600 |
| Pulling Load (N) | 175 | 140 | 130 | 169 | — |
| Leakage from Nozzle | No | No | No | Yes | — |
| Cracking of Nozzle | No | No | No | Yes | Yes |

Note:
(1) $D_3$ represents the diameter of a sleeve.
(2) $r_3$ represents the radius of a semispherical lower end portion.

Effect of the Invention

Using the bottom-pouring-type ladle of the present invention, leakage from the nozzle can be prevented without applying a large load to the stopper rod in closing the nozzle, even with inclusions or a semi-solid melt attached to the tapered surface of the nozzle.

DESCRIPTION OF REFERENCE NUMERALS

1: Bottom-pouring-type ladle.
2: Ladle body.
3, 13: nozzle.
3*a*, 13*a*: Upper opening surface of a nozzle.
4, 14: Stopper.
41, 141: Sleeve of a stopper rod.
41*a*, 141*a*: Lower end portion of a sleeve.
42: Core shaft of a stopper rod.
42*a*: Male screw portion of a core shaft.
42*b*: Spring portion of a core shaft.
5: Arm.
5*a*: Vertical arm portion.
5*b*: Horizontal arm portion.
5*c*: Elongated hole.
6: Elevating mechanism.
7: Support.
7*a*: Nut.
7*b*: Washer.
10: Upper opening of a nozzle
15: Normal line of a spherically tapered surface of a nozzle at a contact point X.
17: Normal line of a spherically tapered surface of a nozzle at the lowest point Y.
$O_1$: Center axis of a nozzle.
$O_2$: Center axis of a stopper rod.
$r_1$: Radius of curvature of a spherically tapered surface.
$r_2$: Radius of an upper opening.
$r_3$: Radius of a semispherical lower end portion.
$D_1$: Outer diameter of a nozzle.
$D_2$: Inner diameter of a nozzle-penetrating hole.
$D_3$: Diameter of a sleeve (semispherical lower end portion) of a stopper rod.
L: Length of a stopper rod.
$L_1$: Length of a sleeve of a stopper rod.
X: Contact point of a lower end portion of a stopper rod with a tapered surface of a nozzle in the first closing step.
Y: Contact point (lowest point) of a lower end portion of a stopper rod with a tapered surface of a nozzle in the second closing step.

What is claimed is:

1. A bottom-pouring ladle comprising a melt-pouring nozzle, a vertically movable stopper rod for opening and closing an upper opening of said nozzle, and an arm supporting the stopper rod;

the upper opening of said nozzle having a reverse-conically tapered surface or a spherically tapered surface providing an inward projecting fan-shaped cross section;

a lower end portion of said stopper rod having a reverse-conically tapered surface or a spherical surface, provided that it has a spherical surface when the upper opening of said nozzle has a reverse-conically tapered surface and it has either a spherical surface or a reverse-conically tapered surface when the upper opening of said nozzle has a spherically tapered surface;

the arm comprising a vertical arm portion and a horizontal arm portion;

the horizontal arm portion having an elongated hole in which a male screw portion of a core shaft of the stopper rod penetrates;

the male screw portion having an outer diameter substantially equal to a width of the elongated hole, so that the core shaft of the stopper rod can be set at an arbitrary horizontal position;

a center axis of said stopper rod always being horizontally separate from a center axis of said nozzle in a state where said stopper rod is upward separate from said nozzle;

when the lower end portion of said stopper rod moving downward comes into contact with the tapered surface of said nozzle, the horizontal distance between the center axis of said stopper rod and the center axis of said nozzle being 2-23 mm, and an angle between a normal line of the tapered surface of said nozzle or the lower end portion of said stopper rod and the center axis of said nozzle is 25° or more, at their contact point;

when said stopper rod further moves downward, the lower end portion of said stopper rod sliding downward along the tapered surface of said nozzle, thereby closing the upper opening of said nozzle; and said stopper rod moving upward along the tapered surface of said nozzle from a position where the upper opening of said nozzle is closed, such that the center axis of said stopper rod is horizontally separated from the center axis of said nozzle.

2. The bottom-pouring ladle according to claim 1, wherein said stopper rod is supported by an arm vertically movable such that its center axis is horizontally separated from the center axis of said nozzle.

3. The bottom-pouring ladle according to claim 1, wherein when said stopper rod is lifted from a state where said nozzle is closed, said stopper rod moves upward along the tapered surface of said nozzle, until the horizontal distance between the center axis of said stopper rod and the center axis of said nozzle becomes 2-23 mm; and when said stopper rod is further lifted, said stopper rod is separated from the tapered surface of said nozzle to open the upper opening of said nozzle.

4. The bottom-pouring ladle according to claim 1, wherein when said nozzle is closed by said stopper rod, an angle between a normal line of the spherically tapered surface of said nozzle or the spherical lower end portion of said stopper rod and the center axis of said nozzle is 60° or less, at their contact point.

5. A method for pouring a melt using a bottom-pouring ladle comprising a melt-pouring nozzle, and a vertically movable stopper rod for opening and closing an upper opening of said nozzle;

the upper opening of said nozzle having a reverse-conically tapered surface or a spherically tapered surface providing an inward projecting fan-shaped cross section; and the lower end portion of said stopper rod having a reverse-conically tapered surface or a spherical surface, provided that it has a spherical surface when the upper opening of said nozzle has a reverse-conically tapered surface and it has either a spherical surface or a reverse-conically tapered surface when the upper opening of said nozzle has a spherically tapered surface;

said method comprising a first opening step, in which said stopper rod is upward separate from said nozzle, with a center axis of said stopper rod always horizontally separate from a center axis of said nozzle;

a first closing step, in which said stopper rod moves downward, such that the lower end portion of said stopper rod comes into contact with the tapered surface of said nozzle, at a position where the horizontal distance between the center axis of said stopper rod and the center axis of said nozzle is 2-23 mm, and an angle between a normal line of the tapered surface of said nozzle or the lower end portion of said stopper rod and the center axis of said nozzle is 25° or more, at their contact point;

a second closing step, in which said stopper rod further moves downward to slide the lower end portion of said stopper rod downward along the tapered surface of said nozzle, thereby closing the upper opening of said nozzle; and a second opening step, in which said stopper rod moves upward along the tapered surface of said nozzle, such that the upper opening of said nozzle is opened, and that the center axis of said stopper rod is horizontally separated from the center axis of said nozzle.

6. The method for pouring a melt according to claim 5, wherein said stopper rod is supported by an arm vertically movable such that its center axis is horizontally separated from the center axis of said nozzle.

7. The method for pouring a melt according to claim 5, wherein said second closing step is conducted, until the horizontal distance between the center axis of said stopper rod and the center axis of said nozzle becomes 2-23 mm.

8. The method for pouring a melt according to claim 5, wherein when said nozzle is closed by said stopper rod, an angle between a normal line of the spherically tapered surface of said nozzle or the spherical lower end portion of said stopper rod and the center axis of said nozzle is 60° or less, at their contact point.

* * * * *